US009765503B2

(12) United States Patent
Lee

(10) Patent No.: US 9,765,503 B2
(45) Date of Patent: Sep. 19, 2017

(54) HYDRAULIC CONTROL SYSTEM FOR CONSTRUCTION MACHINERY

(75) Inventor: Chun-Han Lee, Gimhae-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 303 days.

(21) Appl. No.: 14/236,548

(22) PCT Filed: Aug. 9, 2011

(86) PCT No.: PCT/KR2011/005794
§ 371 (c)(1),
(2), (4) Date: Jan. 31, 2014

(87) PCT Pub. No.: WO2013/022132
PCT Pub. Date: Feb. 14, 2013

(65) Prior Publication Data

US 2014/0174071 A1 Jun. 26, 2014

(51) Int. Cl.
*F15B 11/042* (2006.01)
*E02F 9/22* (2006.01)
(Continued)

(52) U.S. Cl.
CPC ..... *E02F 9/2228* (2013.01); *E02F 9/2296* (2013.01); *F15B 11/055* (2013.01);
(Continued)

(58) Field of Classification Search
CPC ..... F15B 11/0423
See application file for complete search history.

(56) References Cited

U.S. PATENT DOCUMENTS 5,129,230 A 7/1992 Izumi et al.
5,848,531 A 12/1998 Nakamura et al.
(Continued)

FOREIGN PATENT DOCUMENTS

JP 05-66303 U 9/1993
JP 06-297970 A 10/1994
(Continued)

OTHER PUBLICATIONS

Extended European Search Report for Application No. 11870581.3 dated Sep. 16, 2015 (8 pages).
(Continued)

*Primary Examiner* — F. Daniel Lopez
(74) *Attorney, Agent, or Firm* — Harness, Dickey & Pierce, P.L.C.

(57) ABSTRACT

The present invention relates to a hydraulic control system for construction machinery capable of variably adjusting a set pressure of a relief valve, which controls a set pressure of a hydraulic system, according to a value inputted by means of pressure in the hydraulic system or the manipulation of a joystick. The hydraulic control system comprises: a flow control valve installed in a passage between a hydraulic pump and a hydraulic actuator, for controlling the driving of the hydraulic actuator by being switched by a control signal according to the manipulation of the joystick; a main relief valve installed in a passage between an upstream-side discharge passage of the hydraulic pump and a hydraulic tank, for returning a working fluid to the hydraulic tank when a high load exceeding a set pressure occurs in the system; a pressure controlling means for controlling, either continuously or in stages, a set pressure of the main relief valve; a pressure sensing means for sensing a pressure at a discharge side of the hydraulic pump; and a controller for determining the value inputted by the manipulation of the joystick, and a required set pressure for the relief valve according to the system pressure sensed by the pressure sensing means, and then outputting a control signal to the pressure controlling means to enable a set pressure of the relief valve to be variably adjusted to a determined set pressure.

4 Claims, 2 Drawing Sheets

(51) Int. Cl.
*F15B 11/05* (2006.01)
*F15B 13/042* (2006.01)

(52) U.S. Cl.
CPC ..... *F15B 13/0422* (2013.01); *F15B 13/0426* (2013.01); *F15B 11/0423* (2013.01); *Y10T 137/87225* (2015.04)

(56) References Cited

U.S. PATENT DOCUMENTS

| | | | | |
|---|---|---|---|---|
| 7,392,653 | B2 | 7/2008 | Sugano | |
| 7,513,109 | B2 * | 4/2009 | Toji et al. | 60/444 |
| 2005/0204735 | A1 | 9/2005 | Sugano | |
| 2013/0090771 | A1 | 4/2013 | Kim et al. | |
| 2013/0116897 | A1 | 5/2013 | Lee et al. | |
| 2013/0269332 | A1 | 10/2013 | Suk et al. | |

FOREIGN PATENT DOCUMENTS

| | | | |
|---|---|---|---|
| JP | 07-017688 | A | 1/1995 |
| JP | 11-336705 | A | 12/1999 |
| JP | 2000-291074 | A | 10/2000 |
| JP | 2000-310202 | A | 11/2000 |
| JP | 2005-265002 | A | 9/2005 |
| JP | 2007-282849 | A | 11/2007 |

OTHER PUBLICATIONS

International Search Report (in Korean and English) and Written Opinion (in Korean) for PCT/KR2011/005794, mailed Apr. 12, 2012; ISA/KR.

International Preliminary Report on Patentability (Chapter II) (in Korean) for PCT/KR2011/005794, dated Oct. 31, 2013; IPEA/KR.

* cited by examiner

[Fig. 1]

HYDRAULIC CONTROL SYSTEM FOR CONSTRUCTION MACHINERY

FIELD OF THE INVENTION

The present invention relates to a pressure control system for a construction machine. More particularly, the present invention relates to a pressure control system for a construction machine, in which a variable adjustment of the set pressure of a relief valve that limits a set pressure of the hydraulic system can be performed based on the pressure of the hydraulic system or the input value by manipulation of a joystick by a user.

BACKGROUND OF THE INVENTION

In general, in a hydraulic system applied to an excavator or the like, a one or two stage relief value having a set pressure is installed so that the pressure of the hydraulic system can be maintained at a constant level to drive a hydraulic actuator or the like. Such a relief valve is used to perform a pressure boosting function of increasing the set pressure of the relief value upon the selection of the function by an operator depending on the work conditions. That is, the set pressure of the relief valve is boosted temporarily by the operator so that a torque of a force of the hydraulic actuator (e.g., a boom cylinder) can be increased.

In the meantime, the excavator allows a high load to occur during the work so that there frequently occurs a case where a hydraulic fluid discharged from a hydraulic pump is relieved. In this case, when the set pressure of the relief valve is boosted, the discharged hydraulic fluid is not relieved so that a loss of the hydraulic fluid relieved can be reduced. On the other hand, an operator suffers from an inconvenience of carrying out the pressure boosting function depending on the work conditions during the work, and thus such a hydraulic system is practically not applied to the equipment.

DETAILED DESCRIPTION OF THE INVENTION

Technical Problems

Accordingly, the present invention has been made to solve the aforementioned problem occurring in the prior art, and it is an object of the present invention to provide a pressure control system for a construction machine, in which the set pressure of the relief valve is boosted automatically based on the pressure of the hydraulic system or the input value by manipulation of the joystick by a user so that a loss of a hydraulic fluid that is relieved under the work condition of a high load can be reduced, and the set pressure of the relief valve can be maintained at the optimal level to thereby protect the hydraulic parts.

Technical Solution

To accomplish the above object, in one aspect, there is provided a pressure control system for a construction machine in accordance with an embodiment of the present invention, including:

a variable displacement hydraulic pump;

a plurality of hydraulic actuators connected to the hydraulic pump;

a plurality of joysticks configured to respectively output control signals according to manipulation amounts thereof;

a flow rate control valve installed in a flow path between the hydraulic pump and the hydraulic actuators and configured to be shifted to control an operation of the hydraulic actuators in response to a control signal according to an manipulation of each of the joysticks;

a main relief valve installed in a flow path between a discharge flow path on an upstream side of the hydraulic pump and a hydraulic tank and configured to return a hydraulic fluid to the hydraulic tank when a high load that exceeds a set pressure of the main relief valve occurs in the system;

a pressure adjustment means configured to adjust the set pressure of the main relief valve in a consecutive or stepwise manner;

a pressure detection means configured to detect a pressure of the hydraulic fluid on the discharge side of the hydraulic pump 1; and a controller configured to determine the set pressure of the relief valve, which is required according to an input value by the manipulation of the joystick and a system pressure that is detected by the pressure detection means and configured to output a control signal to the pressure adjustment means so as to enable the set pressure of the relief valve to be variably adjusted to the determined set pressure.

In another aspect, there is also provided a pressure control system for a construction machine in accordance with an embodiment of the present invention, including a variable displacement hydraulic pump, a hydraulic actuator connected to the hydraulic pump, a plurality of joysticks, a flow rate control valve configured to be shifted to control the drive of the actuator, a main relief valve configured to return a hydraulic fluid to a hydraulic tank when a high load that exceeds a set pressure of the main relief valve occurs in the system, a pressure adjustment means configured to adjust the set pressure of the main relief valve in a consecutive or stepwise manner, a pressure detection means configured to detect a pressure of the hydraulic fluid on the discharge side of the hydraulic pump, and a controller configured to control the set pressure of the relief valve to be adjusted based on an input value of a control signal by the manipulation of the joystick and a system pressure, the pressure control system including:

a first step of detecting the input value of the control signal by the manipulation of the joystick and the system pressure by the pressure detection means;

a second step of determining the set pressure of the relief valve based on the input value of the joystick and the system pressure, respectively, or determining the set pressure of the relief valve based on both the input value of the joystick and the system pressure;

a third step of determining a final set pressure of the relief valve among the set pressures of the relief valve determined in the second step; and a fifth step of outputting a control signal to the pressure adjustment means to control the pressure of the relief valve to be set to the final set pressure determined in the third step.

In accordance with a preferred embodiment of the present invention, the pressure detection means may be a pressure sensor that detects the pressure of the hydraulic fluid on the discharge side of the hydraulic pump and transmits a detection signal to the controller.

The pressure detection means may be a pressure switch that is turned on/off to generate a signal when the pressure of the hydraulic fluid on the discharge side of the hydraulic pump reaches the set pressure value of the main relief valve.

The pressure adjustment means may be a solenoid valve that is shifted to output a control signal to the relief valve in response to an electric control signal applied thereto from the controller.

The pressure adjustment means may be an electro proportional valve that is driven to output a secondary signal pressure to the relief valve in response to the electric control signal applied thereto from the controller 9.

The input value of the control signal by the manipulation of the joystick may be an input signal by a pressure sensor that detects a pilot pressure.

The input value of the control signal by the manipulation of the joystick may be an input signal by a pressure switch that detects the pilot pressure.

The input value of the control signal by the manipulation of the joystick may be an input signal by an electric joystick.

The set pressure of the relief valve may be set to be relatively lower than the previous set pressure of the relief valve when a control value corresponding to manipulation of the joystick during low load construction work is input to the controller.

The set pressure of the relief valve may be set to be relatively higher than the previous set pressure of the relief valve when a control value corresponding to manipulation of the joystick during high load construction work is input to the controller, or the system pressure is determined to approximate the previous set pressure of the relief valve. After being set to be relatively higher the set pressure of the relief valve is reduced either (1) after a predetermined period of time, or (2) when relief loss is expected due to system pressure being higher than the previously set pressure.

The pressure control system may further include a fourth step S400 of determining whether to activate or inactivate a function of performing an automatic variable adjustment of the set pressure of the relief valve based on the input value of the joystick and the system pressure through selection of a user setting means.

Advantageous Effect

The pressure control system for a construction machine in accordance with an embodiment of the present invention as constructed above has the following advantages.

The set pressure of the relief valve is boosted automatically based on the pressure of the hydraulic system or the input value of the joystick by a user so that a loss of a hydraulic fluid that is relieved under the work condition of a high load can be reduced, thereby improving workability, and the set pressure of the relief valve can be maintained at the optimal level, thereby extending the lifespan of the hydraulic parts.

BRIEF DESCRIPTION OF THE DRAWINGS

The above objects, other features and advantages of the present invention will become more apparent by describing the preferred embodiments thereof with reference to the accompanying drawings, in which.

PREFERRED EMBODIMENTS OF THE INVENTION

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 1:
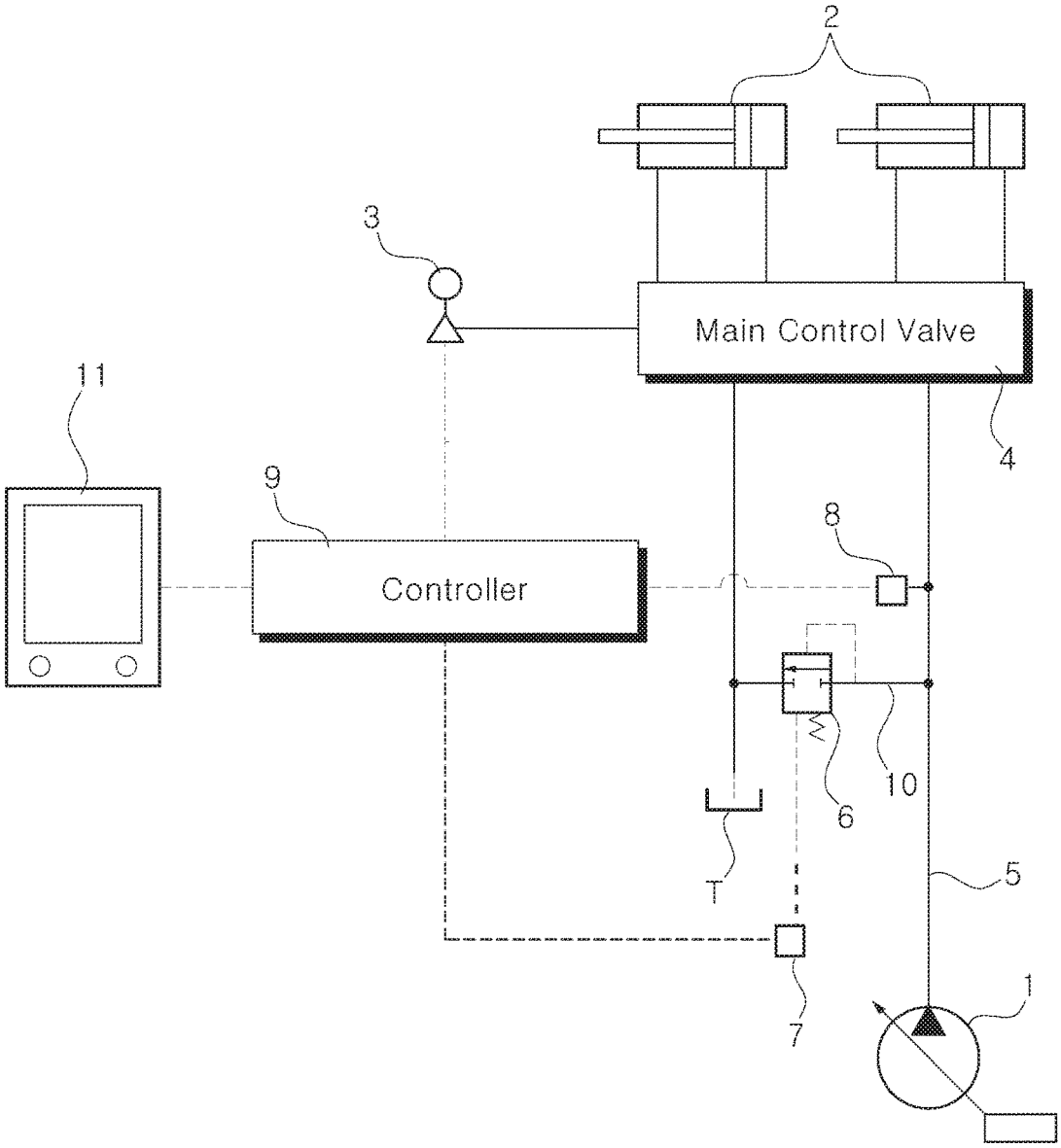
FIG. 1 is a hydraulic circuit diagram showing a pressure control system for a construction machine in accordance with an embodiment of the present invention.

A pressure control system for a construction machine in accordance with an embodiment of the present invention as shown in FIG. 1 includes:

a variable displacement hydraulic pump (hereinafter, referred to as "hydraulic pump") 1;

a plurality of hydraulic actuators (referring to "boom cylinder" and the like) 2 that is connected to the hydraulic pump 1;

a plurality of joysticks 3 that is configured to respectively output control signals according to manipulation amounts thereof;\ a flow rate control valve (MCV) 4 that is installed in a flow path between the hydraulic pump 1 and the hydraulic actuators 2 and is configured to be shifted to control the drive of the hydraulic actuators 2 in response to a control signal according to an manipulation of each of the joysticks 3;

a main relief valve (hereinafter, referred to as "relief valve") 6 that is installed in a flow path 10 between a discharge flow path 5 on an upstream side of the hydraulic pump 2 and a hydraulic tank T and is configured to return a hydraulic fluid to the hydraulic tank when a high load exceeding a set pressure of the main relief valve occurs in the system;

a pressure adjustment means 7 that is configured to adjust the set pressure of the main relief valve 6 in a consecutive or stepwise manner;

a pressure detection means 8 that is configured to detect a pressure of the hydraulic fluid on the discharge side of the hydraulic pump 1; and a controller 9 that is configured to determine the set pressure of the relief valve 6, which is required according to an input value by the manipulation of the joystick and a system pressure that is detected by the pressure detection means and is configured to output a control signal to the pressure adjustment means so as to enable the set pressure of the relief valve 6 to be variably adjusted to the determined set pressure.

In a pressure control system for a construction machine in accordance with an embodiment of the present invention shown in FIGS. 1 and 2 including a variable displacement hydraulic pump 1, a hydraulic actuator (i.e., boom cylinder or the like) 2 connected to the hydraulic pump 1, a plurality of joysticks 3, a flow rate control valve (MCV) 4 configured to be shifted to control the drive of the actuator 2, a main relief valve (hereinafter, referred to as "relief valve") 6 configured to return a hydraulic fluid to a hydraulic tank when a high load that exceeds a set pressure of the main relief valve occurs in the system, a pressure adjustment means 7 configured to adjust the set pressure of the main relief valve 6 in a consecutive or stepwise manner, a pressure detection means 8 configured to detect a pressure of the hydraulic fluid on the discharge side of the hydraulic pump 1, and a controller 9 configured to control the set pressure of the relief valve to be adjusted based on an input value of a control signal by the manipulation of the joystick 3 and a system pressure, the pressure control system includes:

a first step (S100A, S100B) of detecting the input value of the control signal by the manipulation of the joystick 3 and the system pressure by the pressure detection means 8;

a second step (S200A, S200B) of determining the set pressure of the relief valve 6 based on the input value of the control signal of the joystick 3 and the system pressure, respectively, or (S200C) determining the set pressure of the relief valve 6 based on both the input value of the control signal of the joystick 3 and the system pressure;

a third step (S300) of determining a final set pressure of the relief valve 6 among the set pressures of the relief valve determined in the second step (S200A, S200B, S200C), and determining a required relief pressure for the relief valve 6;

a fourth step (S400) of determining whether to activate or inactivate a function of performing an automatic variable adjustment of the set pressure of the relief valve 6 based on the input value of the joystick 3 and the system pressure through selection of a user setting means 11.

a fifth step (S500A, S500B) of outputting a control signal to the pressure adjustment means to control the pressure of the relief valve 6 to be set to the required relief pressure determined in the third step S300.

Herein, the pressure detection means 8 used in the present invention is a pressure sensor that detects the pressure of the hydraulic fluid on the discharge side of the hydraulic pump 1 and transmits a detection signal to the controller 9.

The pressure detection means 8 used in the present invention is a pressure switch that is turned on/off to generate a signal when the pressure of the hydraulic fluid on the discharge side of the hydraulic pump 1 reaches the set pressure value of the main relief valve.

The pressure adjustment means 7 used in the present invention is a solenoid valve that is shifted to output a control signal to the relief valve 6 in response to an electric control signal applied thereto from the controller 9.

The pressure adjustment means 7 used in the present invention is an electro proportional valve that is driven to output a secondary signal pressure to the relief valve in response to the electric control signal applied thereto from the controller 9.

The input value of the control signal by the manipulation of the joystick 3 is an input signal by a pressure sensor that detects a pilot pressure.

The input value of the control signal by the manipulation of the joystick 3 is an input signal by a pressure switch that detects the pilot pressure.

The input value of the control signal by the manipulation of the joystick 3 is an input signal by an electric joystick.

The set pressure of the relief valve 6 is set to be relatively lower than the previous set pressure of the relief valve 6 when a control value of the joystick of a pattern that is manipulated by a low load is inputted to the controller 9.

The set pressure of the relief valve 6 is set to be relatively higher than the previous set pressure of the relief valve 6 when a control value of the joystick of a pattern that is manipulated by a high load is inputted to the controller 9 or the system pressure is determined to approximate the previous set pressure of the relief valve 6.

The set pressure of the relief valve 6 is re-set to be lower than the previous set pressure of the relief valve when the set pressure of the relief valve 6 is set to be higher than the previous set value of the relief valve 6, but the set pressure thereof is maintained over a predetermined time period or approximates a re-set high pressure to expect a relief loss.

Hereinafter, a use example of the pressure control system for a construction machine in accordance with an embodiment of the present invention will be described in detail with reference to the accompanying drawings.

As shown in FIG. 1, when a manipulation signal is inputted to a signal pressure port of the flow rate control valve 4 according to the manipulation of the joystick 3 by an operator to cause a spool of the flow rate control valve 4 to be shifted, a hydraulic fluid discharged from the hydraulic pump 1 is supplied to the actuator 2 via the flow rate control valve 4 along the discharge flow path 5 to drive the actuator 5. For example, the hydraulic fluid from the hydraulic pump 1 is supplied to a large chamber of the boom cylinder to drive the boom cylinder in a stretchable manner. In this case, a hydraulic fluid returned to the flow rate control valve 4 from the actuator 2 is returned to the hydraulic tank T via the flow rate control valve 4. For example, the hydraulic fluid from a small chamber of the boom cylinder is returned to the hydraulic tank T.

At this time, a detection signal of the system pressure detected by the pressure detection means 8 installed on the discharge flow path 5 side of the hydraulic pump 1 and a detection signal of a control signal value by the manipulation of the joystick 3 are transmitted to the controller 9, respectively. For this reason, the controller 9 outputs a control signal to the pressure adjustment means 7 so as to adjust the set pressure of the relief valve 6 based on the control signal input value by the manipulation of the joystick 3 and the system pressure.

An adjustment of the set pressure of the relief valve based on the system pressure and the control signal input value by the manipulation of the joystick 3 as described above will be described hereinafter with reference to the flowchart of FIG. 2.

Figure 2:
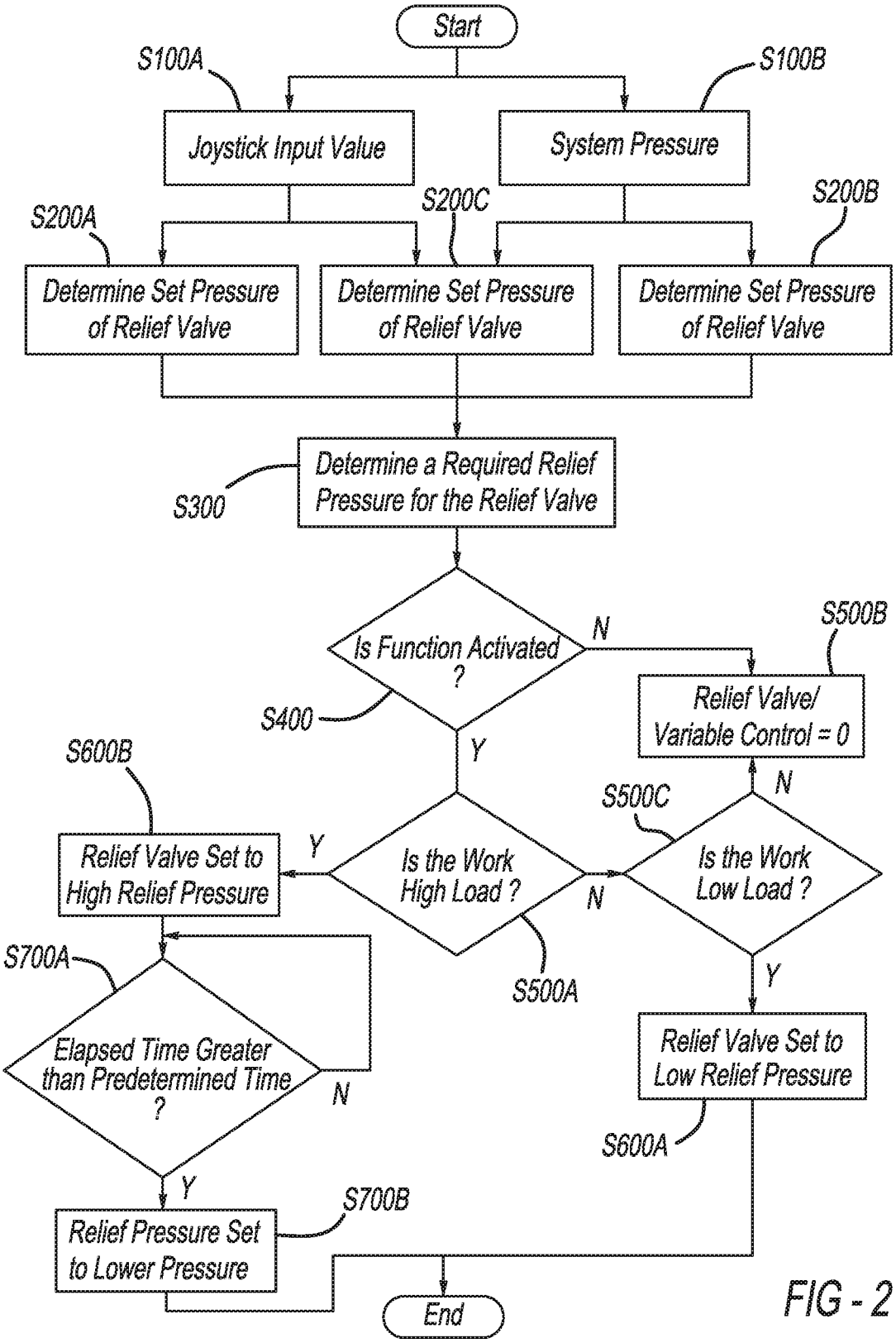
FIG. 2 is a flowchart showing a pressure control system for a construction machine in accordance with an embodiment of the present invention.

As shown in FIG. 2, an input value (S100A) of the control signal by the manipulation of the joystick 3 and the system pressure (S100B) by the pressure detection means 8 are detected, respectively, and detection signals are applied to the controller 9.

At step S200A, the set pressure of the relief valve 6 is determined based on the input value (referring to "instruction value") of the joystick 3. At step S200B, the set pressure of the relief valve 6 is determined based on the system pressure. At step S200C, the set pressure of the relief valve 6 is determined based on both the input value of the joystick 3 and the system pressure.

At subsequent step S300, a final set pressure of the relief valve 6 is determined among the set pressures of the relief valve determined in the second step (S200A, S200B, S200C).

The program proceeds to step S400 where the controller 9 determines whether to activate or inactivate a function of performing an automatic variable adjustment of the set pressure of the relief valve 6 based on the input value of the joystick 3 and the system pressure through selection of a user setting means 11. If it is determined at step S400 that the function of performing an automatic variable adjustment of the set pressure of the relief valve 6 is activated, the program proceeds to step S500A.

On the contrary, it is determined at step S400 that the function of performing an automatic variable adjustment of the set pressure of the relief valve 6 is inactivated, the program proceeds to step S500B where the set pressure of the relief valve 6 is set to a specific value based on the input value of the joystick 3 and the system pressure through selection of the user setting means 11.

At step S500A, an automatic variable adjustment of the set pressure of the relief valve 6 can be performed based on the input value of the joystick 3 and the system pressure.

In this case, the set pressure of the relief valve 6 is set to be relatively lower than the previous set pressure of the relief valve 6 when a control value of the joystick 3 of a pattern that is manipulated by a low load is inputted to the controller 9 so that hydraulic parts can be protected from an instantaneous collision or an external pressure (S500A, S500C, S600A).

In the meantime, at step 600B, the set pressure of the relief valve 6 is set to be relatively higher than the previous set pressure of the relief valve 6 when a control value of the joystick 3 of a pattern that is manipulated by a high load is inputted to the controller 9 or the system pressure is determined to approximate the previous set pressure of the relief valve 6 so that a loss by relief can be minimized.

On the other hand, at steps S700A and 700B, the set pressure of the relief valve 6 is re-set to be lower than the previous set pressure of the relief valve when the set pressure of the relief valve 6 is set to be higher than the previous set value of the relief valve 6, but the set pressure thereof is maintained over a predetermined time period or approximates a re-set high pressure to expect a relief loss.

At step 500B, the set pressure of the relief valve 6 may be set to a specific value required according to the work conditions, i.e., the set pressure of the relief valve 6 is fixed to a selected value without being changed depending on the input value of the joystick 3 and the system pressure.

According to the pressure control system for a construction machine in accordance with an embodiment of the present invention as described above, the set pressure of the relief valve is automatically boosted based on the pressure of the hydraulic system or the input value of the joystick by a user so that a loss of the flow rate of the hydraulic fluid that is relieved under the work condition of a high load can be reduced and the set pressure of the relief valve can be maintained at the optimal level to thereby protect the hydraulic parts.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

INDUSTRIAL APPLICABILITY

As described above, the pressure control system for a construction machine in accordance with an embodiment of the present invention is advantageous in controlling the hydraulic pressure of a construction machine including an excavator or a loader. In addition, the set pressure of the relief valve is automatically boosted based on the pressure of the hydraulic system or the input value of the joystick by a user during the operation of the construction machine so that a loss of a hydraulic fluid that is relieved under the work condition of a high load can be reduced, thereby improving workability, and the set pressure of the relief valve can be maintained at the optimal level, thereby extending the lifespan of the hydraulic parts.

The invention claimed is:

1. A method for controlling a pressure control system for a construction machine, including a variable displacement hydraulic pump, a hydraulic actuator connected to the hydraulic pump, a plurality of joysticks configured to respectively output control signals according to a manipulation amount, a flow rate control valve configured to be shifted to control the drive of the actuator, a relief valve configured to return a hydraulic fluid to a hydraulic tank when pressure of the hydraulic fluid exceeds a relief pressure of the relief valve during a high load construction work or a low load construction work, a pressure adjustment means configured to adjust the relief pressure of the relief valve in response to a pressure relief signal applied from a controller, a pressure detection means configured to detect a system pressure of the hydraulic fluid on a discharge side of the hydraulic pump, the pressure control method comprising:

the controller determines a normal required relief pressure based on the output control signals generated in response to the manipulation amount of the plurality of joysticks and the system pressure;

determining whether a function of performing an automatic variable adjustment of the required relief pressure is activated, based on whether an automatic variable adjustment mode has been selected by a user through a user setting means;

setting the pressure relief signal to the normal relief pressure, when the function of performing an automatic variable adjustment of the required relief pressure is not activated;

setting the pressure relief signal to a higher relief pressure, higher than the normal relief pressure, during the high load construction work, when the function of performing an automatic variable adjustment of the required relief pressure is activated;

setting the pressure relief signal to a lower relief pressure, lower than the normal relief pressure, during the low load construction work, when the function of performing an automatic variable adjustment of the required relief pressure is activated;

outputting the pressure relief signal from the controller to the pressure adjustment means instructing the pressure adjustment means to adjust the relief pressure of the main relief valve according to the pressure relief signal; and resetting the pressure adjustment means by outputting the pressure relief signal from the controller after the pressure relief signal is reset from the higher relief pressure to a decreased relief pressure, lower than the higher relief pressure, when the relief pressure of the main relief valve has been the higher relief pressure for a predetermined period of time.

2. The method according to claim 1, wherein the pressure detection means includes a switch that detects the pressure of the hydraulic fluid on the discharge side of the hydraulic pump and transmits a detection signal to the controller.

3. The method according to claim 1, wherein the pressure adjustment means is a solenoid valve that is shifted to output a control signal to the relief valve in response to the signal applied thereto from the controller.

4. The method according to claim 1, wherein the pressure adjustment means is an electro proportional valve that is driven to output a secondary signal pressure to the relief valve in response to the signal applied thereto from the controller.

* * * * *